US007762884B2

(12) United States Patent
Okada

(10) Patent No.: US 7,762,884 B2
(45) Date of Patent: Jul. 27, 2010

(54) SLOT MACHINE AND PLAYING METHOD THEREOF

(75) Inventor: Kazuo Okada, Tokyo (JP)

(73) Assignee: Aruze Gaming America, Inc., Las Vegas, NV (US)

( * ) Notice: Subject to any disclaimer, the term of this patent is extended or adjusted under 35 U.S.C. 154(b) by 643 days.

(21) Appl. No.: 11/716,687

(22) Filed: Mar. 12, 2007

(65) Prior Publication Data

US 2008/0058087 A1 Mar. 6, 2008

Related U.S. Application Data

(60) Provisional application No. 60/842,017, filed on Sep. 5, 2006.

(51) Int. Cl.
*A63F 9/24* (2006.01)

(52) U.S. Cl. ..... 463/20; 463/13; 463/16; 463/25; 273/292

(58) Field of Classification Search ..... None
See application file for complete search history.

(56) References Cited

U.S. PATENT DOCUMENTS 5,989,121 A * 11/1999 Sakamoto ..... 463/20
5,997,401 A * 12/1999 Crawford ..... 463/20
6,093,102 A 7/2000 Bennett
6,126,541 A * 10/2000 Fuchs ..... 463/13
6,270,412 B1 * 8/2001 Crawford et al. ..... 463/20
6,604,999 B2 8/2003 Ainsworth
2002/0065124 A1 5/2002 Ainsworth

FOREIGN PATENT DOCUMENTS

GB 2137392 * 1/1984

* cited by examiner

*Primary Examiner*—M. Sager
(74) *Attorney, Agent, or Firm*—NDQ&M Watchstone LLP

(57) ABSTRACT

In a case where a plurality of symbols are rearranged on a display, a control for controlling a plurality of rearranged symbols to be capable of being selected, holding selected symbols according to a selection, and arranging selected symbols by carrying them over to a next game is carried out, and a control for making particular symbols among a plurality of rearranged symbols to be capable of being selected only in a case where a payout for the rearranged symbol exceeds a prescribed payout amount and a condition for having a special symbol displayed on the display is satisfied is carried out. In addition, a control for determining a number of symbols that can be selected among a plurality of rearranged symbols and a number of times of the unit game by which these selected symbols can be held is carried out.

12 Claims, 14 Drawing Sheets

FIG. 4

| CODE NO. | SYMBOL |
|---|---|
| 00 | APPLE |
| 01 | JACKPOT 7 |
| 02 | BLUE 7 |
| 03 | CHERRY |
| 04 | ORANGE |
| 05 | CRAB |
| 06 | STRAWBERRY |
| ⋮ | |

FIG. 5

| WINNING COMBINATION | | | | | PAYOUT |
|---|---|---|---|---|---|
| APPLE | APPLE | APPLE | APPLE | APPLE | BONUS GAME |
| JACKPOT 7 | JACKPOT 7 | JACKPOT 7 | JACKPOT 7 | JACKPOT 7 | 50 COINS |
| CHERRY | CHERRY | CHERRY | CHERRY | CHERRY | 20 COINS |
| ORANGE | ORANGE | ORANGE | ——— | ——— | 3 COINS |
| ⋮ | ⋮ | ⋮ | ⋮ | ⋮ | ⋮ |

(SYMBOLS SCROLLING DISPLAY PROCESSING)

SLOT MACHINE AND PLAYING METHOD THEREOF

CROSS-REFERENCE TO RELATED APPLICATION

This application is based upon and claims the benefit of U.S. Provisional Application No. 60/842,017, filed on Sep. 5, 2006; the entire contents of which are incorporated herein by reference.

BACKGROUND OF THE INVENTION

1. Field of the Invention

The present invention relates to a slot machine for playing games by using a game medium such as coin or bill, and a playing method thereof.

2. Description of Related Art

In the conventional slot machine, when a player inserts the game medium such as medal, coin or bill into an insertion slot of the slot machine and inputs a spin button, a plurality of symbols are displayed as a scrolling display at a display unit provided on a front side of a cabinet, and then each symbol is automatically stopped.

Then, as disclosed in U.S. Pat. No. 6,604,999B2 and U.S. Patent Application Publication US2002065124A1, there are two types including one that make a payout determined by a combination of rearranged symbols on a valid line and one that determines a payout by a number of symbol called scatter which is displayed regardless of a valid line. Namely, it is common to determine a prize for symbols according to a number of symbols displayed in the above described scatter. On the other hand, U.S. Pat. No. 6,093,102 discloses a slot machine with a concept of awarding a prize in a case where pictures are aligned on a prescribed line.

In such a conventional slot machine, the game comprises only the automatic stopping of the symbols displayed by the scrolling display, so that there are demands for new slot machines that are much more entertaining.

SUMMARY OF THE INVENTION

The first aspect of the present invention is a slot machine, comprising: a display having a plurality of display regions, for arranging and rearranging symbols in the display regions in each unit game; and a controller operable to: (a) determine a number of symbols that can be held in a current unit game among symbols rearranged in the display regions by a previous unit game, (b) set as many symbols that have been set to be capable of being held as the number of symbols that can be held in the current unit game among symbols to be rearranged in the display regions as capable of being held in the current unit game, and (c) set symbols that have not been set to be capable of being held also as capable of being held in the current unit game only in a case where a payout amount in the previous unit game reached a prescribed payout amount.

According to the slot machine of the first aspect of the present invention, a number of symbols that can be held in the current unit game among symbols rearranged in the display regions by the previous unit game is determined. Then, as many symbols that have been set to be capable of being held as the number of symbols that can be held in the current unit game among symbols to be rearranged in the display regions are set as capable of being held in the current unit game, and symbols that have not been set to be capable of being held are also set as capable of being held in the current unit game only in a case where a payout amount in the previous unit game reached a prescribed payout amount.

The second aspect of the present invention is a slot machine, comprising: a display having a plurality of display regions, for arranging and rearranging symbols in the display regions in each unit game; and a controller operable to: (a) randomly determine an upper limit for a number of symbols that can be held in a current unit game among symbols rearranged in the display regions by a previous unit game, (b) set as many symbols that have been set to be capable of being held as the number of symbols that can be held in the current unit game among symbols to be rearranged in the display regions as capable of being held in the current unit game, and (c) set symbols that have not been set to be capable of being held also as capable of being held in the current unit game only in a case where a payout amount in the previous unit game reached a prescribed payout amount.

According to the slot machine of the second aspect of the present invention, an upper limit for a number of symbols that can be held in the current unit game among symbols rearranged in the display regions by the previous unit game is determined randomly.

The third aspect of the present invention is a slot machine, comprising: a display having a plurality of display regions, for arranging and rearranging symbols in the display regions in each unit game; and a controller operable to: (a) randomly determine an upper limit for a number of symbols that can be held in a current unit game among symbols rearranged in the display regions by a previous unit game, (b) set as many symbols that have been set to be capable of being held as the number of symbols that can be held in the current unit game among symbols to be rearranged in the display regions as capable of being held in the current unit game, (c) set symbols that have not been set to be capable of being held also as capable of being held in the current unit game only in a case where a payout amount in the previous unit game reached a prescribed payout amount, and (d) set a number of times by which symbols are to be set as capable of being held consecutively, for those symbols which are rearranged at identical display regions in each unit game.

According to the slot machine of the third aspect of the present invention, a number of times by which symbols are to be set as capable of being held consecutively is set, for those symbols which are rearranged at identical display regions in each unit game and which are to be set as capable of being held in the current unit game.

The fourth aspect of the present invention is a playing method of a slot machine, comprising the steps of: (a) setting as many symbols that have been set to be capable of being held as a determined number among a plurality of symbols arranged in a plurality of display regions provided in a display by a previous unit game as capable of being held in a current unit game, when the current unit game is started; and (b) setting symbols that have not been set to be capable of being held also as capable of being held in the current unit game only in a case where a payout amount in the previous unit game reached a prescribed payout amount.

According to the slot machine of the fourth aspect of the present invention, as many symbols that have been set to be capable of being held as a determined number among a plurality of symbols arranged in a plurality of display regions provided in a display by a previous unit game are set as capable of being held in a current unit game, when the current unit game is started. Then, symbols that have not been set to be capable of being held are also set as capable of being held in the current unit game only in a case where a payout amount in the previous unit game reached a prescribed payout amount.

The fifth aspect of the present invention is a playing method of a slot machine, comprising the steps of: (a) setting as many symbols that have been set to be capable of being held as a randomly determined number among a plurality of symbols arranged in a plurality of display regions provided in a display by a previous unit game as capable of being held in a current unit game, when the current unit game is started; and (b) setting symbols that have not been set to be capable of being held also as capable of being held in the current unit game only in a case where a payout amount in the previous unit game reached a prescribed payout amount.

According to the slot machine of the fifth aspect of the present invention, an upper limit for a number of symbols that can be held in the current unit game among symbols rearranged in the display regions by the previous unit game is determined randomly.

The sixth aspect of the present invention is a playing method of a slot machine, comprising the steps of: (a) setting as many symbols that have been set to be capable of being held as a randomly determined number among a plurality of symbols arranged in a plurality of display regions provided in a display by a previous unit game as capable of being held in a current unit game, when the current unit game is started; (b) setting symbols that have not been set to be capable of being held also as capable of being held in the current unit game only in a case where a payout amount in the previous unit game reached a prescribed payout amount; and (c) setting a number of times by which symbols are to be set as capable of being held consecutively, for those symbols which are rearranged at identical display regions in each unit game.

According to the slot machine of the sixth aspect of the present invention, a number of times by which symbols are to be set as capable of being held consecutively is set, for those symbols which are rearranged at identical display regions in each unit game and which are to be set as capable of being held in the current unit game.

BRIEF DESCRIPTION OF THE DRAWINGS

FIG. 4 is a diagram showing code numbers of symbols displayed in display regions of a slot machine according to one embodiment of the present invention.

FIG. 5 is a diagram showing a payout table which sets a relationship between a winning combination and a payout amount.

DETAILED DESCRIPTION OF THE EMBODIMENT

Figure 1:
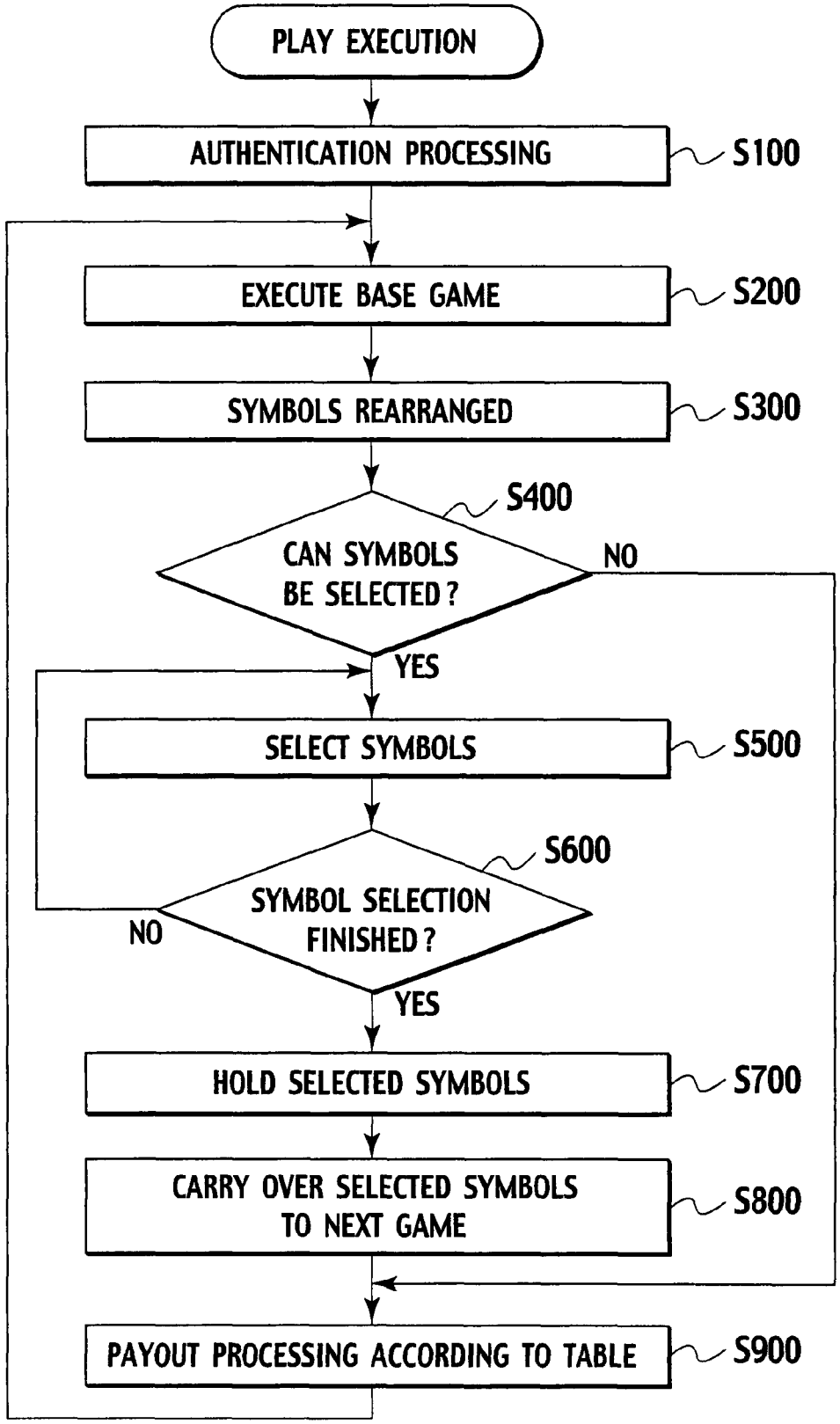
FIG. 1 is a flow chart showing a playing method of a slot machine according to one embodiment of the present invention.

FIG. 1 is a flow chart schematically showing a playing method of a slot machine according to an embodiment of the present invention. In the following, the schematic operations in the slot machine and the playing method according to an embodiment of the present invention will be described with references to the flow chart shown in FIG. 1 and a diagram shown in FIG. 2.

In the slot machine according to an embodiment of the present invention, when the power is turned on and the slot machine is activated, an authentication processing is carried out first (step S100). In this authentication processing, the initial checking processing at a preliminary stage before starting a base game (a unit game), such as whether a program for operating the system is operating normally or not, whether there is any alteration of a program or not, etc., is carried out.

Next, a base game is executed (step S200). In this base game, when a spin button 23 is pressed in a state where a desired credit amount is bet by entering coins into a coin slot 21 or the like, a unit game in which the scrolling of a symbol in each display region 28 (28*a* to 28*o*) of a liquid crystal display 17 provided inside display windows 15 which are provided on a front face of a cabinet 11 is started independently and then the scrolling is stopped and the symbol in each of the display regions 28 is stopped (rearranged) is executed.

In each base game, a processing for determining a symbol to be stopped in each display region 28 (28*a* to 28*o*) is carried out, and symbols are rearranged (step S300). Then, when a combination of symbols to become a bonus trigger are stopped on a payline (formed by display regions 28*f* to 28*j*, for example) that is set at a middle level of each display region 28, such as when symbols "APPLE" are stopped on the payline, for example, a transition to a bonus game is made.

Figure 3:
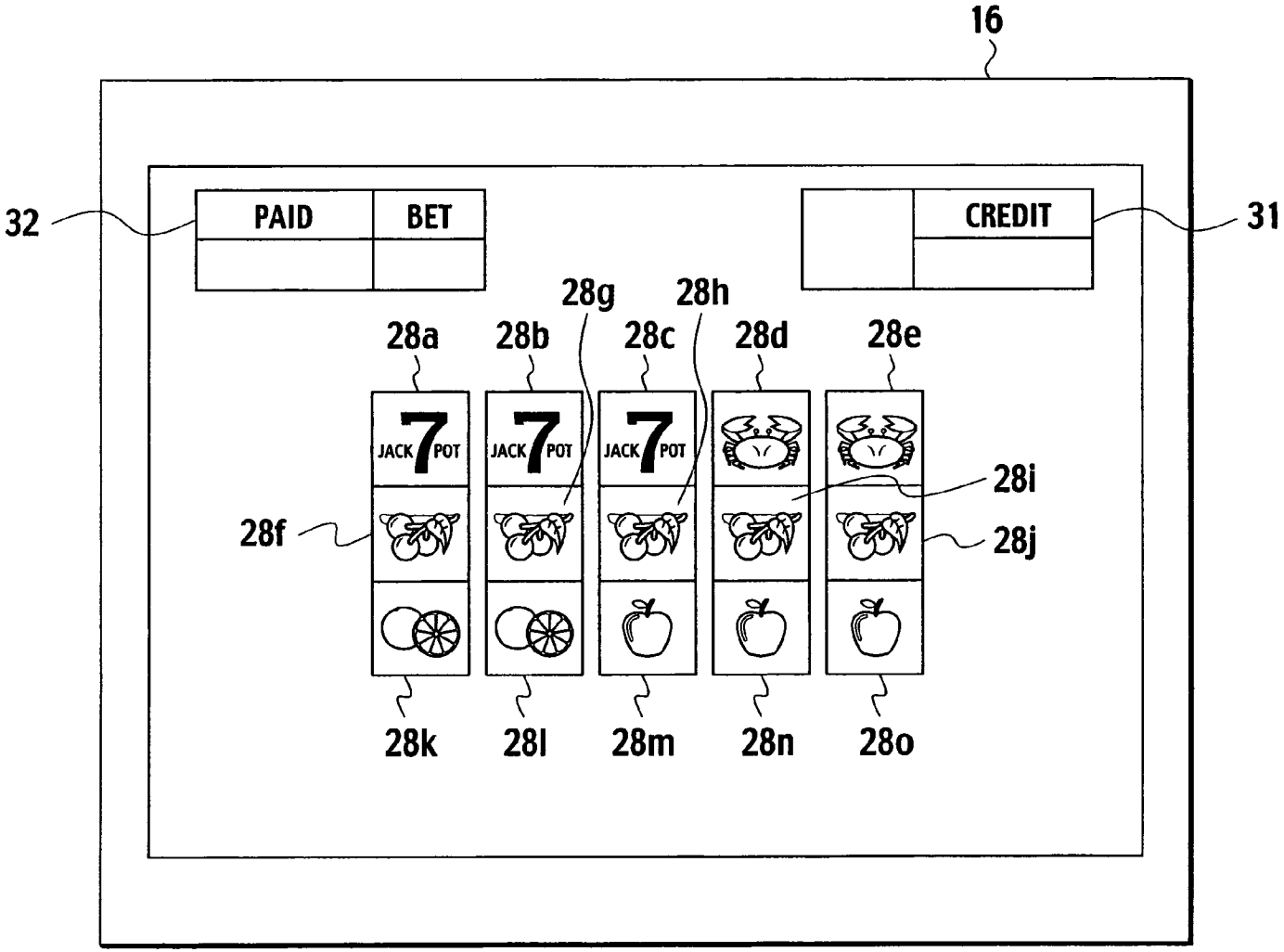
FIG. 3 is a diagram showing symbols displayed in display regions and a payline of a slot machine according to one embodiment of the present invention.

Here, the paylines will be described with reference to FIG. 3. In this example, the paylines include a line formed by the display regions 28*a* to 28*e*, a line formed by the display regions 28*f* to 28*j*, a line formed by the display regions 28*k* to 28*o*, a line formed by the display regions 28*a*, 28*g*, 28*m*, 28*i* and 28*e*, and a line formed by the display regions 28*k*, 28*g*, 28*c*, 28*i* and 28*o*. Also, as a condition for realizing the payout, the payout is realized not only in a case where five identical symbols are stopped on the payline but also in a case where three identical symbols are stopped consecutively as well (see FIG. 5). Here, a function of a wild card may be given to a prescribed symbol. Namely, a prescribed symbol plays a role of a substitute for all symbols when it constitutes the payline, for example.

Also, a winning combination is realized on the above described payline, but it may be made such that a prescribed payout is realized according to a number of symbols arranged, for example, that is, when a prescribed number, such as five for example, of prescribed symbols, such as "ORANGE" for example, are randomly rearranged in the display regions 28. In this example, it is assumed that a winning combination is realized on a payline, for the sake of convenience.

In the case where symbols are rearranged in the display regions 28, a judgement as to whether to make these rearranged symbols capable of being selected or not is made (here, it is assumed that a number of base games for which symbols can be held is limited, and a number of symbols to be selected is determined randomly by using a random number means).

Then, a condition is also set for types of symbols that can be selected. Namely, there are symbols that are set to be capable of being selected and particular symbols that are set to be not capable of being selected, and a special symbol such as "JACKPOT 7" is also made to be capable of being selected in a case where a winning combination associated with a payout greater than a prescribed payout amount is realized when symbols are rearranged.

Then, the processing proceeds to the step S500 in a case where a selection of symbols is possible, and the processing proceeds to the step S900 in a case where a selection of symbols is not possible (step S400).

In the case where a selection of symbols is possible, a symbol corresponding to an external input from a player is selected within a limit of a number of symbols that can be selected among rearranged (stopped) symbols. This processing is repeated within a range of a number of symbols that can be selected (step S500, step S600). As described above, a particular symbol such as "JACKPOT 7" for example can also be selected when the payout amount for the rearranged symbols is greater than a prescribed amount.

Also, at a time of selection, the selection processing is completed by pressing positions corresponding to the display regions 28 (28*a* to 28*o*) by a touch panel 69.

Next, a processing for carrying symbols (displaying symbols as stopped in the display regions 28, for example) over to a next unit game (from the previous base game to the current base game) is carried out (steps S700, S800) as a result of holding code numbers of symbols selected by the player among rearranged symbols and the display regions 28 corresponding to the selected symbols.

After that, the payout according to the payout table is made (step S900). For example, for a winning combination in which five symbols "CHERRY" are stopped on the payline, a payout of 20 coins is made according to the payout table (see FIG. 5).

In the above described example, the case of stopping and displaying symbols in the display regions 28 (28*a* to 28*e*) in the display windows 15 has been described, but the present invention is not limited to a case of 15 display regions 28. Moreover, the case of displaying symbols in the display regions 28 by using the liquid crystal display 17 has been described, but it is also possible to use a configuration using cylindrically shaped mechanical rotation reels which have a plurality of symbols displayed on their side faces, in which these rotation reels are rotated and then stopped such that symbols are stopped inside the display windows 15.

Next, a configuration of the slot machine 10 according to one embodiment of the present invention will be described with reference to a diagram shown in FIG. 2. This slot machine 10 is provided within a gaming facility.

In the slot machine 10, the coins, bills or electronic value information corresponding to these will be used as the game medium for executing the unit game. However, the game medium that can be used in the present invention is not limited to these, and can be medals, tokens, electronic money, or tickets, for example. The tickets are not limited to any particular tickets and can be tickets with bar codes, for example, as will be described below.

Figure 2:
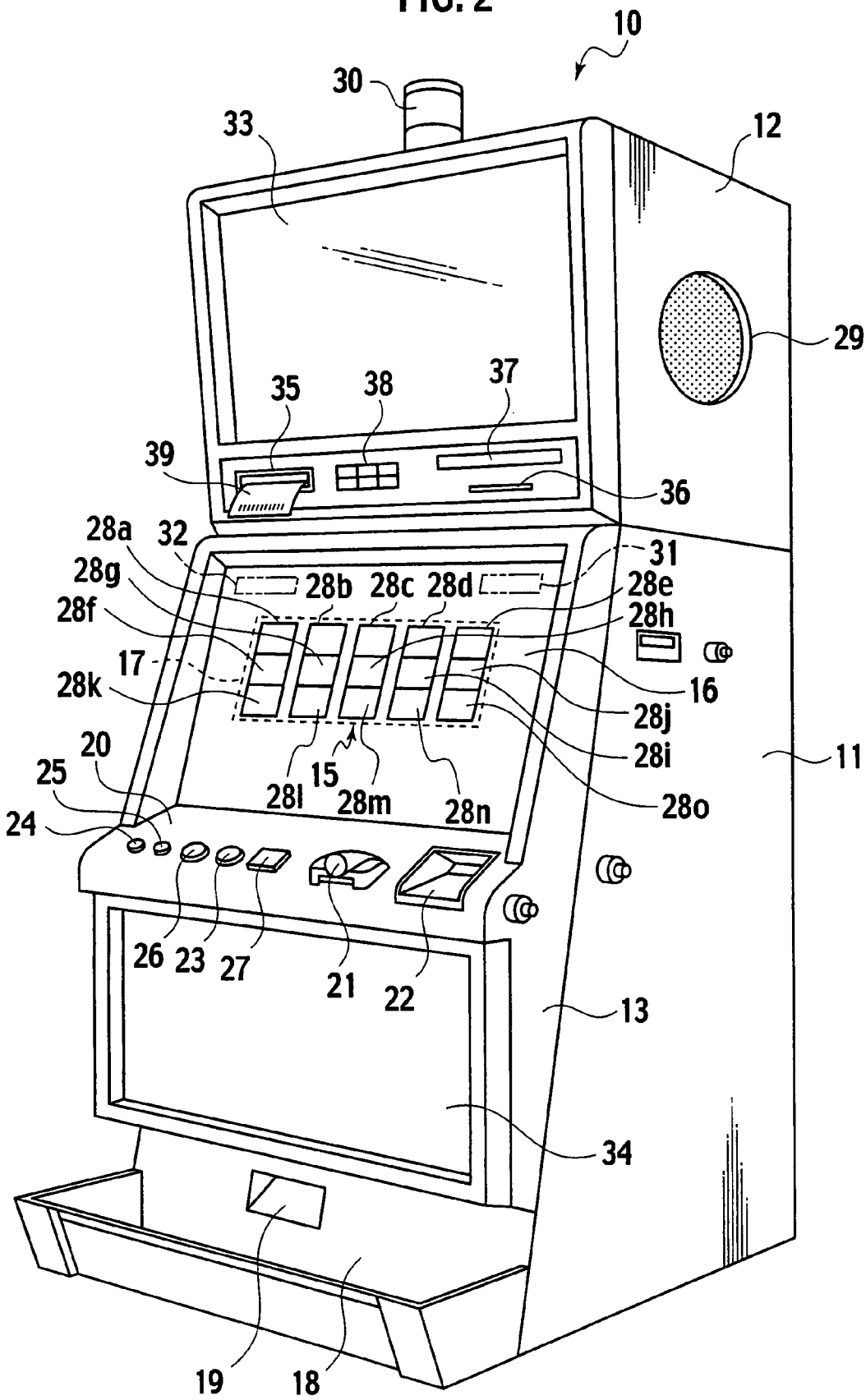
FIG. 2 is a diagram showing an outward appearance of a slot machine according to one embodiment of the present invention.

As shown in FIG. 2, the slot machine 10 has a cabinet 11, a top box 12 provided on an upper side of the cabinet 11, and a main door 13 provided on a front side of the cabinet 11.

Inside the cabinet 11, a liquid crystal display 17 for scrolling 15 symbols inside the display windows 15 is provided, and the liquid crystal display 17 has the display regions 28 (28*a* to 28*o*) for displaying 15 symbols. Namely, when the base game is executed, the symbols are independently scrolled in the display regions 28 (28*a* to 28*o*), such that it becomes possible for the player to see the scrolled symbols through the display windows 15.

Note that, in this embodiment, an exemplary case of using the 15 display regions 28 (28*a* to 28*o*) of the liquid crystal display 17 as a display is described, but it is also possible to display symbols through the display windows 15 by rotating and then stopping mechanical reels displaying symbols on their side faces. Also, the display regions 28 are not limited to be 15.

On a front side of the liquid crystal display 17 in the main door 13, a lower side image display panel 16 is provided. The lower side image display panel 16 has a transparent liquid crystal panel, on which various information regarding the game and the effect images will be displayed during the game.

On the lower side image display panel 16, a credit amount display unit 31 and a payout amount display unit 32 are provided. On the credit amount display unit 31, the number of coins credited is displayed by an image. On the payout amount display unit 32, the number of coins to be paid in the case where a combination of symbols that are stopped on the payline is the winning combination as will be described below is displayed by an image.

The display windows 15 through which symbols displayed in the 15 display regions 28 (28*a* to 28*o*) of the liquid crystal display 17 provided inside of the lower side image display panel 16 are visible are provided on the lower side image display panel 16. Also, a plurality of paylines are formed. The payline defines a combination of symbols. In the case where a combination of symbols that are stopped on the payline is the winning combination, the number of coins according to that winning combination and the number of coins entered (BET number) will be paid.

Namely, as described above with reference to FIG. 3, three paylines that run horizontally across the display windows 15 at the upper, middle and lower levels, or paylines that run obliquely (V-shaped, inverted V-shaped, etc.) are formed, such that as many paylines as the number according to the number of coins entered are set active, and if a combination of symbols that are stopped on the payline that is set active is the winning combination, the payout of as many coins as according to that combination will be made.

On a front face of the lower side image display panel 16, a touch panel 69 (see FIG. 6) is provided, such that the player can input various types of commands by operating the touch panel 69.

For example, in the case where a selection of symbols is possible, a symbol is selected from rearranged (stopped) symbols within a limit of a number of symbols that can be selected according to the intention of the player. This processing is repeated as many times as the number of symbols that can be selected. Then, at a time of selection, the selection processing is completed by pressing positions corresponding to the display regions 28 (28*a* to 28*o*) by the touch panel 69. Then, the code numbers corresponding to the selected symbols are held in the RAM 43.

On a lower side of the lower side image display panel 16, a control panel 20 having a plurality of buttons 23-27 through which commands regarding the progress of the game will be inputted by the player, the coin slot 21 for receiving coins into the cabinet 11, and a bill validator 22 are provided.

Also, in this embodiment, such a touch panel can be a touch panel adopted in the mobile terminal or the ATM of the bank.

On the control panel 20, a spin button 23, a change button 24, a cashout button 25, a 1-BET button 26, and a Max-BET button 27 are provided. The spin button 23 is a button for inputting a command for start scrolling symbols displayed in the display regions 28. The change button 24 is a button to be used at a time of requesting changes to an attendant of the gaming facility. The cashout button 25 is a button for inputting a command for paying the credited coins to a coin tray 18.

The 1-BET button 26 is a button for inputting a command for betting one coin among the credited coins to the game. The Max-BET button 27 is a button for inputting a command for betting maximum number (50, for example) of coins that can be bet per game among the credited coins to the game.

The bill validator 22 validates whether a bill is the legitimate one or not and accepts a legitimate bill into the cabinet 11. The bill validator 22 may have a configuration capable of reading a bar code attached ticket 39 to be described below. On the lower front surface of the main door 13, that is on the lower part of the control panel 20, there is provided a belly glass 34 on which characters of the slot machine 10 and the like are depicted.

On a front surface of the top box 12, an upper side image display panel 33 is provided. The upper side image display panel 33 has a liquid crystal panel, and on this liquid crystal panel, the effect image or the image for introducing the game content or explaining game rules, for example, will be displayed.

Also, on the top box 12, a speaker 29 for outputting sound is provided. On the lower side of the upper side image display panel 33, a ticket printer 35, a card reader 36, a data display 37, and a key pad 38 are provided. The ticket printer 35 prints a bar code which encodes data such as the credit amount, the date and time, the identification number of the slot machine 10, etc., on the ticket, and outputs it as the bar code attached ticket 39. The player can use the bar code attached ticket 39 to play the game on another slot machine or exchange the bar code attached ticket 39 with the bills or the like at the cashier or the like of the gaming facility.

The card reader 36 carries out reading of data from a smart card and writing of data into a smart card. The smart card is a card to be owned by the player, which stores data for identifying the player or data regarding log of games played by the player, for example.

The data display 37 comprises a fluorescent display or the like, and displays data read by the card reader 36, or data inputted by the player through the key pad 38, for example. The key pad 38 inputs data and commands regarding the ticket issuance or the like.

The display regions 28 (28*a* to 28*o*) provided in the liquid crystal display 18 provided inside the cabinet 11 are scrolled. Namely, the symbols comprising a plurality of code numbers are scrolled independently in the display regions 28 (28*a* to 28*o*).

Also, the symbols are stored in correspondence to the code numbers in a table as shown in FIG. 4.

Namely, symbols to be displayed in the display regions 28 (28*a* to 28*o*) such as symbols "APPLE", "JACKPOT 7", "BLUE 7", "CHERRY", "ORANGE", "CRAB", "STRAWBERRY", etc., are set in correspondence to the code numbers "00", "01", "02", "03", "04", "05", "06", etc. Also, a winning combination associated with a payout is set by a combination of symbols described above. Also, as a table for determining a payout when a winning combination is realized, a payout table is set up.

FIG. 5 is a diagram showing the payout table. This payout table is selected in the case of executing the ordinary base game. As shown in FIG. 5, in the case where five symbols "APPLE" are stopped on the payline of the display regions 28 (28*a* to 28*o*), for example, it becomes a bonus trigger and a transition of the game mode from the base game to the bonus game is made. Also, when five symbols "JACKPOT 7" are stopped on the payline, the payout of 50 coins will be made. This "JACKPOT 7" is a special symbol which is set such that a higher payout than ordinary symbols will made.

Also, in the case where five symbols "CHERRY" are stopped on the payline, the payout of 20 coins will be made. Then, in the case where three symbols "ORANGE" are consecutively stopped on the payline, the payout of 3 coins will be made (the description of the other patterns will be omitted).

The bonus game to be executed when a combination of symbols APPLE" is stopped on the payline is a game mode more advantageous than the base game. In the present embodiment, the bonus game is a free game (a game that can be played for a prescribed number of times without betting any coins). In the present invention, the bonus game is not particularly limited as long as it is more advantageous game mode for the player. Also, the bonus game that is more advantageous to the player is not particularly limited as long as it is more advantageous than the base game, and for example, it is possible to consider a mode in which more numerous gaming medium than the base game can be obtained, a mode in which the gaming medium can be obtained at a higher probability than the base game, a mode in which the amount of gaming medium to be consumed is less than the base game, etc. More specifically, a free game, a second game, etc. can be considered as the bonus game.

The symbols displayed (arranged) in the display regions 28 (28*a* to 28*o*) starts scrolling when the 1-BET button 26 or the Max-BET button 27 is pressed and then the spin button 23 is pressed after that. When the scrolling of the symbols is started, the scrolling of the symbols will be stopped (rearranged) after a prescribed period of time has elapsed. At this point, symbols will be stopped in the display regions 28 (28*a* to 28*o*) as shown in FIG. 3 in a pattern as shown in FIG. 4.

In addition, various types of winning combinations are predetermined for each symbol (see FIG. 5), and in the case where the symbols that constitute the winning combination are stopped on the payline, the amount of coins to be paid according to the winning combination will be added to the credit owned by the player. Also, when the bonus game trigger is realized, that is, when a combination of five symbols "APPLE" is stopped on the payline in this embodiment, a transition of the game mode from the base game to the bonus game will be made.

Figure 6:
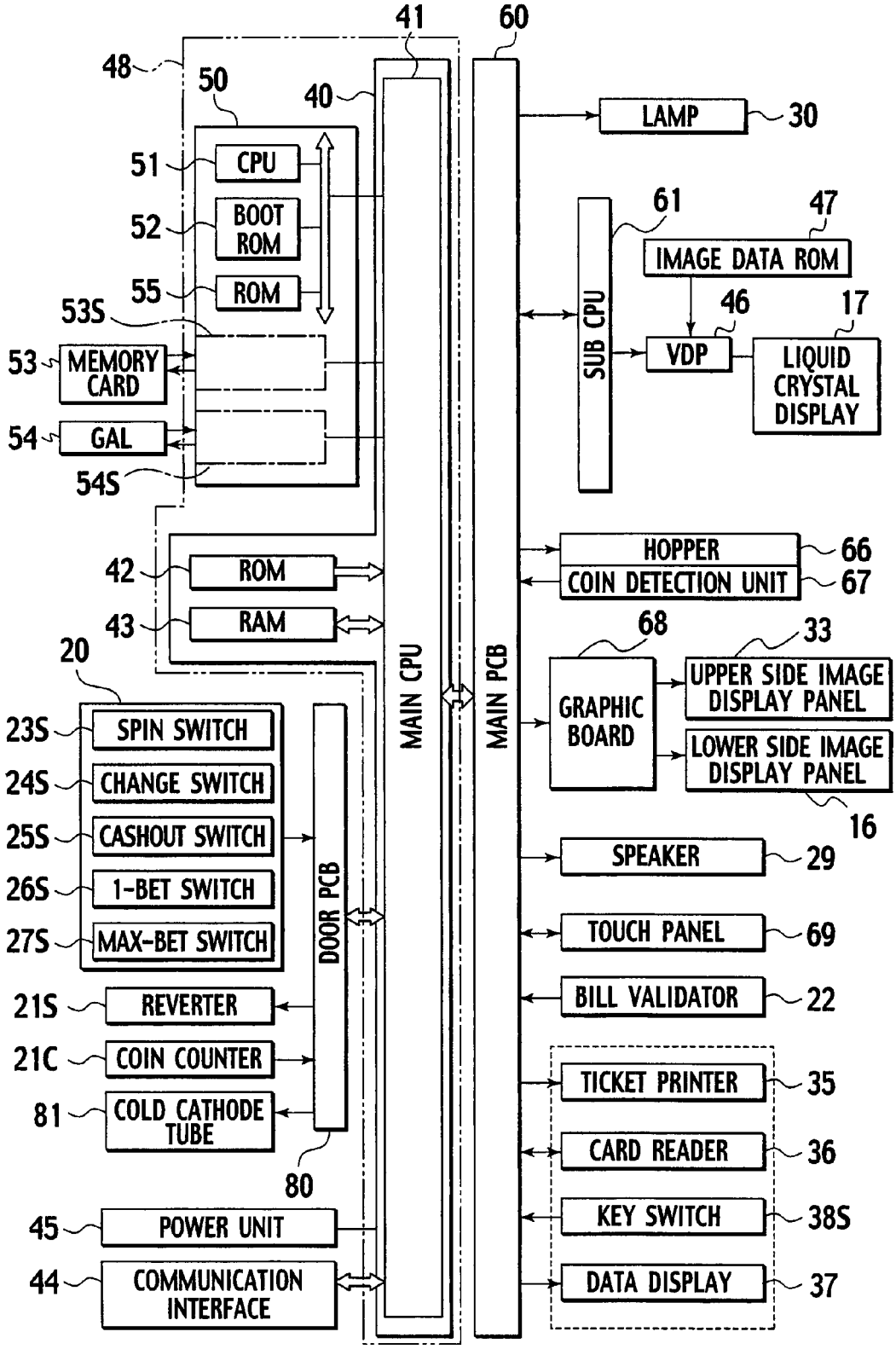
FIG. 6 is a block diagram showing a control circuit of a slot machine according to one embodiment of the present invention.

FIG. 6 is a block diagram showing a control circuit of the slot machine 10 shown in FIG. 2. As shown in FIG. 6, the control circuit comprises a mother board 40, a main body PCB (Printed Circuit Board) 60, a gaming board 50, a sub CPU 61, a door PCB 80, and various types of switches and sensors.

The gaming board 50 has a CPU (Central Processing Unit) 51, a ROM 55 and a boot ROM 52 which are mutually connected through an internal bus, a card slot 53S corresponding to a memory card 53, and an IC socket 54S corresponding to a GAL (Generic Array Logic) 54.

The memory card 53 stores a game program and a game system program. The game program includes a symbols to be stopped determination program. The symbols to be stopped determination program is a program for determining symbols (code numbers corresponding to symbols) to be stopped on the payline in the display regions 28 (28*a* to 28*o*). This symbols to be stopped determination program contains symbol weighing data respectively corresponding to plural types of payout rates (80%, 84%, 88%, for example). The symbol weighing data are data indicating the correspondence relationship between the code number of each symbol (see FIG. 4), and one or a plurality of random number values belonging to a prescribed numerical value range (0 to 256), for each of the display regions 28 (28*a* to 28*o*).

The payout rate is determined according to the payout rate setting data outputted from the GAL 54. The symbols to be stopped are determined according to the symbol weighing data corresponding to this payout rate.

Also, the card slot 53S is formed such that the memory card 53 can be inserted or extracted, and connected to the mother board 40 through the IDE bus. Consequently, by extracting the memory card 53 from the card slot 53S, writing the other game program and game system program into the memory card 53, and inserting that memory card 53 into the card slot 53S, it is possible to change a type and a content of the game to be played on the slot machine 10.

The game program includes a program related to the game progress and a program for making a transition to the bonus game. The game program also contains image data and sound data to be outputted during game play. The game program further contains a program for carrying out a control of making a plurality of rearranged symbols capable of being selected when a plurality of symbols are rearranged on a display, holding selected symbols according to a selection, and carrying over the selected symbols to a next base game and arranging them.

The GAL 54 has a plurality of input ports and output ports, and when data are inputted into the input ports, data corresponding to these data are outputted from the output ports. The data outputted from the output ports are the payout rate setting data mentioned above.

Also, the IC socket 54S is formed such that the GAL 54 can be attached or detached, and connected to the mother board 40 through the PCI bus. Consequently, by detaching the GAL 54 from the IC socket 54S, rewriting the program stored in the GAL 54, and attaching that GAL 54 to the IC socket 54S, it is possible to change the payout rate setting data to be outputted from the GAL 54.

The CPU 51, the ROM 55 and the boot ROM 52 that are mutually connected through the internal bus are connected to the mother board 40 through the PCI bus. The PCI bus carries out the signal transmission between the mother board 40 and the gaming board 50, as well as the power supply from the mother board 40 to the gaming board 50. The ROM 55 stores a country identification information and an authentication program. The boot ROM 52 stores a spare authentication program and a program (boot codes) for the CPU 51 to activate the spare authentication program.

The authentication program is a program (alteration checking program) for authenticating the game program and the game system program. Namely, the authentication program is a program for carrying out the checking and the verification of the fact that the game program and the game system program are not altered. The authentication program is described along a procedure for carrying the authentication of the game program and the game system program. The spare authentication program is a program for authenticating the above described authentication program. The spare authentication program is described along a procedure for carrying out the verification that the authentication program that is a target of the authentication processing is not altered, that is, the authentication of the authentication program.

The mother board 40 has a main CPU 41, a ROM (Read Only Memory) 42, a RAM (Random Access Memory) 43, and a communication interface 44.

The mother board 40 and the gaming board 50 comprise a controller 48.

The main CPU 41 has a function of controlling the slot machine 10 overall. In particular, the main CPU 41 carries out a control for outputting a command signal to make the sub CPU 61 to scroll symbols in the display regions 28 (28*a* to 28*o*) of the liquid crystal display 17 when the credit is bet and the spin button 23 is pressed, a control for determining symbols to be stopped on the payline after the symbols in the display regions 28 (28*a* to 28*o*) are scrolled, and a control for displaying symbols such that the determined symbols are stopped on the payline.

Namely, the main CPU 41 carries out an arrangement control in which a plurality of symbols displayed on the display (liquid crystal display 17) are scrolled, and then symbols to be arranged into a symbol matrix are selected and determined from a plurality of types of symbols in order to rearrange them as a new symbol matrix, and the scrolling state is stopped at the determined symbols.

In addition, the main CPU 41 carries out a control to determine a number of symbols that can be held in the current base game among symbols rearranged in the display regions 28 (28*a* to 28*o*) in the previous base game (unit game), set as many symbols as those determined to be capable of being held as capable of being held among those which have been set as capable of being held among symbols to be rearranged in the display regions, and set even the symbol (JACKPOT 7) that has not been set as capable of being held as capable of being held in the current base game only in a case where a payout amount by the previous base game reached a prescribed payout amount.

Also, the main CPU 41 carries out a control for randomly setting an upper limit for a number of symbols that are set to be capable of being held among symbols arranged in the display regions 28 in the previous base game (unit game).

Also, the main CPU 41 carries out a control for setting a number of times for which symbols rearranged in the identical display regions 28 in each base game (unit game) can be held consecutively.

The ROM 42 stores programs such as BIOS (Basic Input/Output System) to be executed by the main CPU 41, as well as data to be used permanently. When the BIOS is executed by the main CPU 41, the processing for initializing each peripheral device is carried out and the processing for reading the game program and the game system program stored in the memory card 53 through the gaming board 50 is started.

The RAM 43 stores data and programs to be used when the main CPU 41 carries out the processing.

The communication interface 44 carries out communications with the host computer or the like that is provided inside the gaming facility through a communication channel.

Also, to the Mother board 40, a main body PCB (Printed Circuit Board) 60 and a door PCB 80 to be described below are connected through the respective USB (Universal Serial Bus). In addition, a power source unit 45 is connected to the mother board 40. When the power is supplied from the power source unit 45 to the mother board 40, the main CPU 41 of the mother board 40 is activated, and the power is supplied to the gaming board 50 through the PCI bus and the CPU 51 is activated.

To the main body PCB 60 and the door PCB 80, devices for generating input signals to be inputted into the main CPU 41 and devices whose operations are to be controlled by control signals outputted from the main CPU 41 are connected. The main CPU 41 executes the game program and the game system program stored in the RAM 43 according to the input signals inputted into the main CPU 41. Then, the main CPU 41 carries out the calculation processing according to these programs and stores the result into the RAM 43, and the processing for transmitting control signals to each device as the control processing with respect to each device.

To the main body PCB 60, a lamp 30, a sub CPU 61, a hopper 66, a coin detection unit 67, a graphic board 68, a speaker 29, a touch panel 69, a bill validator 22, a ticket printer 35, a card reader 36, a key switch 38S, and a data display 37 are connected.

The lamp 30 is controlled to be turned on or off according to the control signal outputted from the main CPU 41.

The sub CPU 61 carries out the control for scrolling symbols in the display regions 28 (28*a* to 28*o*) that are set in the liquid crystal display 17, and is connected to a VDP (Video Display Processor) 46.

The VDP 46 reads out the image data of symbols stored in the image data ROM 47, generates the scrolling images to be displayed at the liquid crystal display 17, and outputs the scrolling images to the liquid crystal display 17.

The hopper 66 is provided inside the cabinet 11, and pays the prescribed number of coins according to the control signal outputted from the main CPU 41, from a coin payout opening 19 to a coin tray 18. The coin detection unit 67 is provided inside the coin payout opening 19, and outputs an input signal to the main CPU 41 when it detects that the prescribed number of coins are paid from the coin payout opening 19.

The graphic board 68 controls the image display other than symbols to be displayed in the display regions 28 on the upper side image display panel 33 and the lower side image display panel 16 according to the control signal outputted from the main CPU 41. On the credit amount display unit 31 of the lower side image display panel 16, the credit amount stored in the RAM 43 is displayed. Also, on the payout amount display unit 32 on the lower side image display panel 16, the number of coins to be paid is displayed. Also, the graphic board 68 has a VDP for generating image data according to the control signal outputted from the main CPU 41 and a video RAM for temporarily storing the image data generated by the VDP.

The bill validator 22 reads an image of the bill and accepts the legitimate bill into the cabinet 11. The bill validator 22 outputs an input signal to the main CPU 41 according to the amount of that bill when the legitimate bill is accepted. The main CPU 41 stores the credit amount according to the amount of the bill notified by that input signal into the RAM 43.

The ticket printer 35 prints the bar code which encodes data such as the credit amount stored in the RAM 43, the date and time, and the identification number of the slot machine 10, etc., on the ticket, according to the control signal outputted from the main CPU 41, and outputs it as the bar code attached ticket 39.

The card reader 36 reads data from the smart card and transmit it to the main CPU 41, or writes data into the smart card according to the control signal outputted from the main CPU 41. The key switch 38S is provided on the key pad 38, and outputs an input signal to the main CPU 41 when the key pad 38 is operated by the player.

The data display 37 displays the data read by the card reader 36 or the data inputted by the player through the key pad 38, according to the control signal outputted from the main CPU 41.

To the door PCB 80, a control panel 20, a reverter 21S, a coin counter 21C and a cold cathode tube 81 are connected. On the control panel 20, a spin switch 23S corresponding to a spin button 23, a change switch 24S corresponding to a change button 24, a cashout switch 25S corresponding to a cashout button 25, a 1-BET switch 26S corresponding to a 1-BET button 26, and a Max-BET switch 27S corresponding to a Max-BET button 27 are provided. Each one of the switches 23S to 27S outputs an input signal to the main CPU 41 when the corresponding one of the buttons 23-27 is operated by the player.

The coin counter 21C is provided inside the coin slot 21, and validates whether coins entered at the coin slot 21 are legitimate ones or not. Those coins that are not the legitimate ones will be ejected from the coin payout opening 19. Also, the coin counter 21C outputs an input signal to the main CPU 41 when the legitimate coins are detected.

The reverter 21S is operated according to a control signal outputted from the main CPU 41, to distribute the coins recognized as the legitimate coins by the coin counter 21C to the cash box (not shown) provided inside the slot machine 10 or the hopper 66. Namely, when the hopper 66 is filled with coins, the legitimate coins are distributed to the cash box by the reverter 21S. On the other hand, when the hopper 66 is not filled with coins, the legitimate coins are distributed to the hopper 66.

The cold cathode tube 81 functions as the background light provided on the back side of the lower side image display panel 16 and the upper side image display panel 33, and it is turned on according to a control signal outputted from the main CPU 41.

Figure 7:
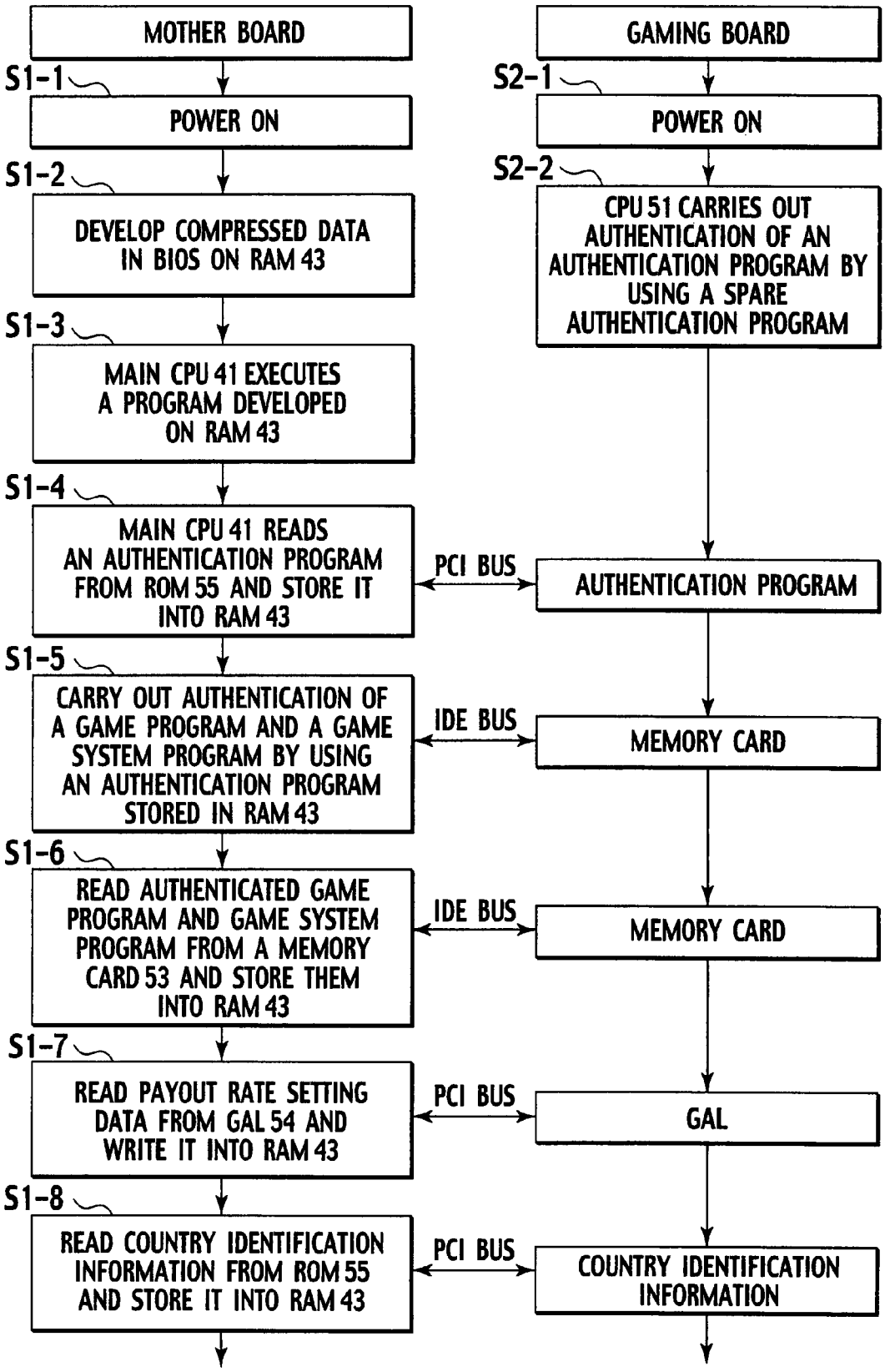
FIG. 7 is a flow chart showing a procedure of an authentication and reading processing of a game program and a game system program by a mother board and a gaming board of a slot machine according to one embodiment of the present invention.

Next, the specific processing to be carried out at the slot machine 10 will be described. FIG. 7 is a flow chart showing a procedure of the authentication and reading processing for the game program and the game system program (processing at the step S100 shown in FIG. 1), by the mother board 40 and the gaming board 50 shown in FIG. 6. Note here that it is assumed that the memory card 53 is attached to the card slot 53S and the GAL 54 is attached to the IC socket 54S on the gaming board 50.

First, when the power switch is turned on at the power source unit 45, the mother board 40 and the gaming board 50 are activated (steps S1-1, S2-1). When the mother board 40 and the gaming board 50 are activated, the respective independent processings will be carried out in parallel. Namely, at the gaming board 50, the CPU 51 carries out the reading of the spare authentication program stored in the boot ROM 52, and the spare authentication for checking and verifying that the authentication program is not altered in advance, according to the read out spare authentication program, before it is taken into the mother board 40 (step S2-2).

On the other hand, at the mother board 40, the main CPU 41 executes the BIOS stored in the ROM 42 and expands the compressed data incorporated in the BIOS over the RAM 43 (step S1-2). Then, the main CPU 41 executes the BIOS expanded on the RAM 43 to carry out the diagnosis and initialization of various types of peripheral devices (step S1-3).

Then, as the ROM 55 of the gaming board 50 is connected to the main CPU 41 through the PCI bus, the main CPU 41 carries out the reading of the authentication program stored in the ROM 55. In addition, the main CPU 41 carries out the processing for storing the read out authentication program into the RAM 43 (step S1-4).

Next, the main CPU 41 makes an access to the memory card 53 that is attached to the card slot 53S through the IDE bus. Then, the main CPU 41 carries out the reading of the game program and the game system program stored in the memory card 53.

Next, the main CPU 41 carries out the authentication for checking and verifying that the read out game program and game system program are not altered, according to the authentication program stored in the RAM 43 (step S1-5).

When this authentication processing is finished normally, the main CPU 41 stores the authenticated game program and game system program into the RAM 43 (step S1-6). Next, the main CPU 41 makes an access to the GAL 54 that is attached to the IC socket 54S through the PCI bus, reads out the payout rate setting data from the GAL 54, and stores it into the RAM 43 (step S1-7). Next, the main CPU 41 carries out the reading of the country identification information stored in the ROM 55 of the gaming board 50, and stores the read out country identification information into the RAM 43 (step S1-8).

After carrying out the above described processing, the main CPU 41 sequentially reads out and executes the game program and the game system program, to proceed with the base game as described below.

Figure 8:
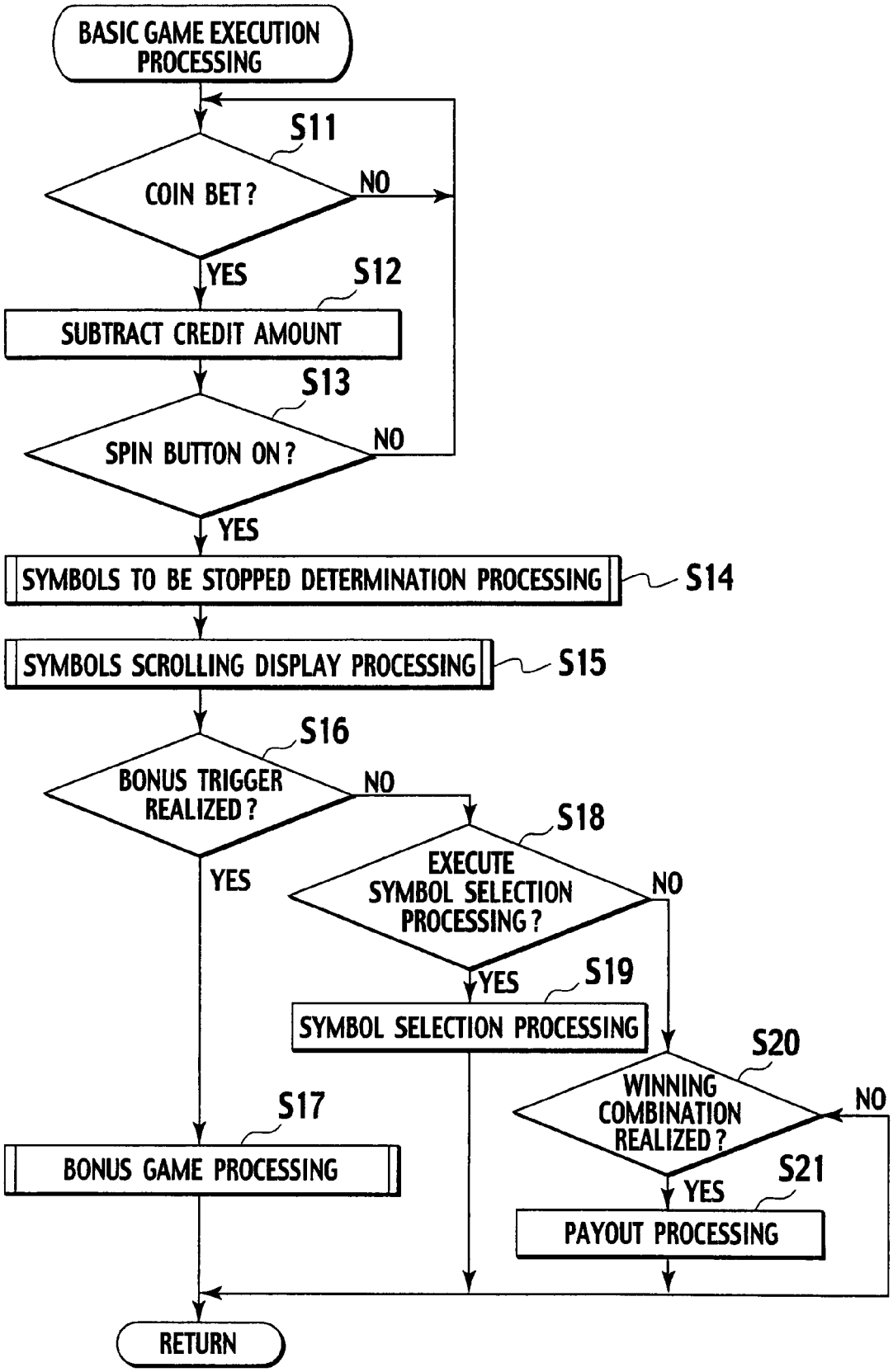
FIG. 8 is a flow chart showing a procedure of a base game processing to be executed by a slot machine according to one embodiment of the present invention.

After the authentication and reading processing shown in FIG. 7 is carried out, the main CPU 41 carries out the base game execution processing. FIG. 8 is a flow chart showing the specific processing procedure of the base game execution processing shown at the step S200 of FIG. 1.

In the base game execution processing, first, the main CPU 41 judges whether the coin BET has been made or not (step S11). In this processing, the main CPU 41 judges whether the input signal outputted from the 1-BET switch 26S when the 1-BET button 26 is pressed or the input signal outputted from the Max-BET switch 27S when the Max-BET button 27 is pressed has been received or not. When it is judged that the coin BET has not been made, the processing returns to the step S11.

On the other hand, at the step S1, when it is judged that the coin BET has been made, the main CPU 41 carries out the processing for subtracting the credit amount stored in the RAM 43 according to the number of coins to be bet (step S12). Note that when the number of coins to be bet is greater than the credit amount stored in the RAM 43, the processing is returned to the step S11, without carrying out the processing for subtracting the credit amount stored in the RAM 43. Note also that when the number of coins to be bet exceeds the upper limit value (50 in this embodiment) that can be bet per one game, the processing proceeds to the step S13, without carrying out the processing for subtracting the credit amount stored in the RAM 43. In this state, it becomes a state where it is possible to display symbols by the scrolling display in the first display regions 28 (28*a* to 28*e*).

Next, the main CPU 41 judges whether the spin button 23 is turned ON or not (step S13). In this processing, the main CPU 41 judges whether the input signal outputted from the spin switch 23S when the spin button 23 is turned ON is received or not.

When it is judged that the spin button 23 is not turned ON, the processing is returned to the step S11. Note that in the case where the spin button 23 is not turned ON (the case where a command indicating the finishing of the game is inputted without turning the spin button 23 ON, for example), the main CPU 41 cancels the subtraction result at the step S12.

In this embodiment, the exemplary case of carrying out the processing for subtracting the credit amount (step S12) after the coin BET is made (step S11), before making the judgement as to whether the spin button 23 is turned ON or not (step S13) will be described. However, the present invention is not limited to this exemplary case. For example, it is also possible to make the judgement as to whether the spin button 23 is turned ON or not (step S13) after the coin BET is made (step S11), and carry out the processing for subtracting the credit amount (step S12) when it is judged that the spin button 23 is turned ON (step S13 YES).

Then, at the step S13 of FIG. 8, when it is judged that the spin button 23 is turned ON, the main CPU 41 carries out the symbols to be stopped determination processing (step S14). In this symbols to be stopped determination processing, the main CPU 41 determines symbols to be displayed through the display windows 15 at a time of stopping symbols in the display regions 28 (28*a* to 28*o*) by executing the symbols to be stopped determination program stored in the RAM 43. In this way, the combination of symbols to be stopped on the payline is determined.

Next, the main CPU 41 carries out the symbols scrolling display processing (step S15). This processing is a processing for stopping symbols in the display regions 28 (28*a* to 28*o*) after the scrolling of symbols in the display regions 28 (28*a* to 28*o*) is started, such that symbols determined at the step S14 will be stopped on the payline.

Next, the main CPU 41 judges whether the bonus trigger is realized or not, that is, whether a combination of symbols "APPLE" is stopped on the payline or not (step S16), and when it is judged that the bonus trigger is realized, the main CPU 41 executes the bonus game processing to be described below (step S17).

On the other hand, when it is judged that the bonus trigger is not realized, the main CPU 41 judges whether to make a selection of rearranged symbols possible or not (whether a selection is possible or not is related to the fact that a number of games in which symbols can be selected is limited, and that the number of symbols that can be selected is randomly determined by using a random number means) (step S18). When it is judged that a symbol selection processing is to be carried out, a processing for holding symbols selected among rearranged symbols is carried out (step S19).

Also, in the case of not carrying out a symbol selection processing, the main CPU 41 judges whether the winning combination is realized or not, that is, whether a combination of symbols "ORANGE" is stopped or not, for example (step S20), and when it is judged that the winning combination is realized, the main CPU 41 carries out the payout processing corresponding to this winning combination (step S21).

In the case of depositing the coins to be paid, the main CPU 41 adds the prescribed amount of credits to the credit amount stored in the RAM 43. Also, in the case of paying out the coins, the main CPU 41 makes the payout of a prescribed amount of coins by transmitting the control signal to the hopper 66. At this point, the coin detection unit 67 counts the number of coins paid from the hopper 66, and transmits a payout completion signal to the main CPU 41 when the count value reached the specified number. As a result, the main CPU 41 stops the driving of the hopper 66 and finishes the coin payout processing.

In the case where it is judged that the winning combination is not realized (step S20 NO), that is in the case of the lost game, the coins will not be paid out. In this way, the base game will be executed.

Figure 9:
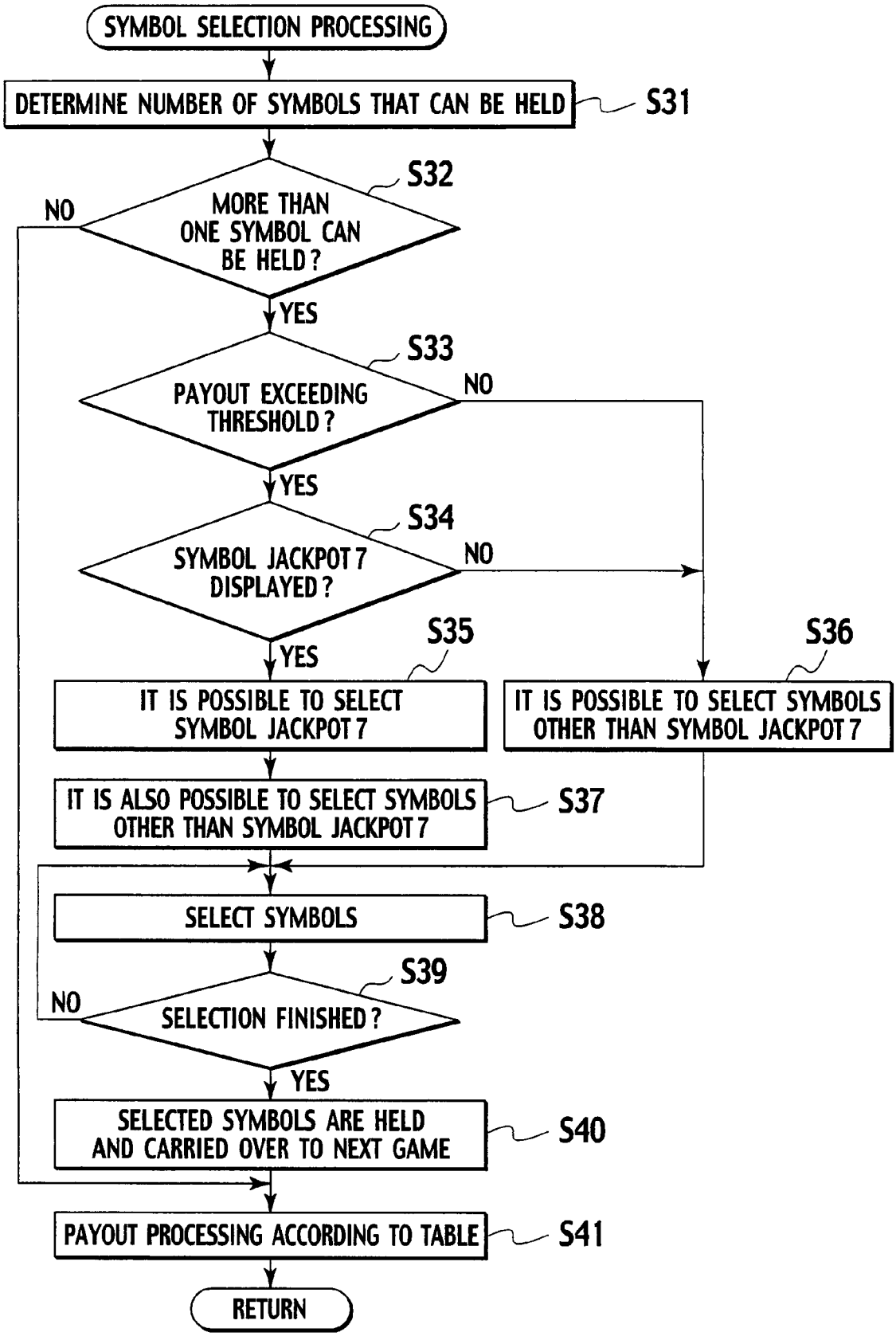
FIG. 9 is a flow chart showing a procedure of a winning combination holding processing to be executed by a slot machine according to one embodiment of the present invention.

FIG. 9 is a flow chart showing in detail a procedure of the symbol selection processing of step S19 shown in FIG. 8. The main CPU 41 randomly determines a number of symbols that can be selected from the scrolled symbols that are rearranged in the display regions 28 (28*a* to 28*o*) (step S31). Here, the randomly determined number can be "0". Namely, in the case of "0", no symbol can be selected. In addition, it may be made to carry out a control for determining a number of base games (unit games) for which the selected symbols can be held.

In this example, it is assumed that it becomes possible to select three symbols by the determination based on a random number generation, for example.

Then, the main CPU 41 judges whether a number of symbols that can be held is greater than or equal to one or not. When the number of symbols that can be selected is greater than or equal to one, the processing proceeds to the step S33. When the number of symbols that can be selected is "0" (that is, when the symbol selection processing is not to be carried out), the processing proceeds to the step S41 (step S32).

Next, in the case where the selection of symbols is possible, the main CPU 41 judges whether a payout for a winning combination of symbols rearranged is exceeding a prescribed payout amount or not. When it is judged that it is exceeding a prescribed payout amount, the processing proceeds to the step S34. When it is judged that it is not exceeding a prescribed payout amount, the processing proceeds to the step S36 (step S33).

Figure 14A:
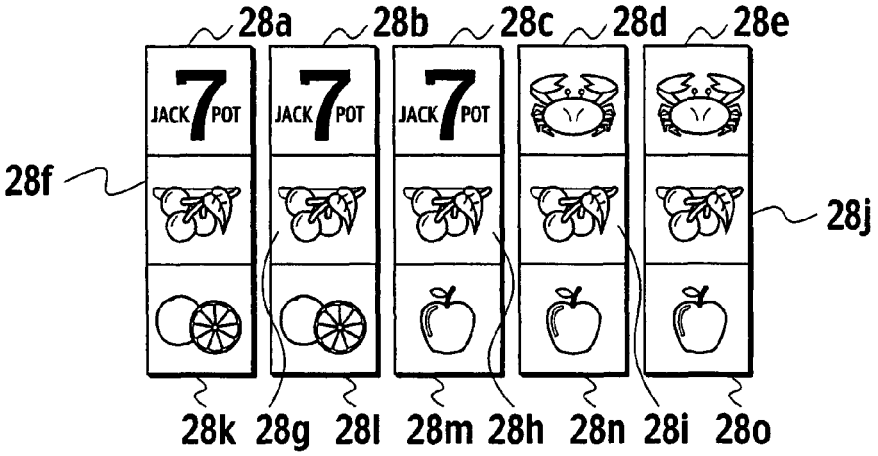
FIG. 14A is a diagram showing a case where symbols are rearranged and a selection becomes possible.

For example, assuming that the winning combination is realized by symbols "CHERRY (payout of 20 coins)" displayed in the display regions 28*f* to 28*j* as shown in FIG. 14A, if the prescribed payout amount is payout of 15 coins or more, the processing proceeds to the step S34.

Next, the main CPU 41 judges whether a special symbol "JACKPOT 7" is displayed in the display regions 28 (28*a* to 28*o*) or not. When it is judged that the special symbol "JACKPOT 7" is displayed, the processing proceeds to the step S35. On the other hand, when it is judged that the special symbol "JACKPOT 7" is not displayed, the processing proceeds to the step S36 (step S34). This symbol "JACKPOT 7" is set in the payout table (FIG. 5) such that a higher payout (50 coins) than ordinary symbols will be made.

In the case where the payout for the winning combination is exceeding the prescribed payout amount and the special symbol "JACKPOT 7" is displayed in the display regions 28 (28*a* to 28*o*), it becomes possible to select the special symbol "JACKPOT 7" and the other symbols (that is, all the symbols) (step S35, step S37). It also becomes possible to select the symbol "JACKPOT 7" because "JACKPOT 7" is stopped in the display regions 28*a*, 28*b* and 28*c* as shown in FIG. 14A.

On the other hand, in the case where the condition is not satisfied at the above described step S33 or step S34, it is not possible to select the special symbol "JACKPOT 7" but it becomes possible to select any other symbols (step S36). At this point, it is preferable to make the display of the special symbol "JACKPOT 7" different from the display of the other symbols (display it a lighter color, for example).

Under the condition of whether the selection of symbols is possible or not as described above, the player makes a selection of as many symbols as determined by the step S31 (step S38, step S39).

The touch panel (see FIG. 6) is provided, so that the player makes the selection according to the player's own intention within a limit of a number of symbols that can be selected from the rearranged (stopped) symbols, by operating the touch panel 69. This processing is repeated for as many times as the number of symbols to be selected, Then, at a time of the selection, the selection processing is completed by pressing positions corresponding to the display regions 28 (28*a* to 28*o*) by the touch panel 69. Note that it is made such that the selection will be released when the once selected symbol is selected again.

Figure 13:
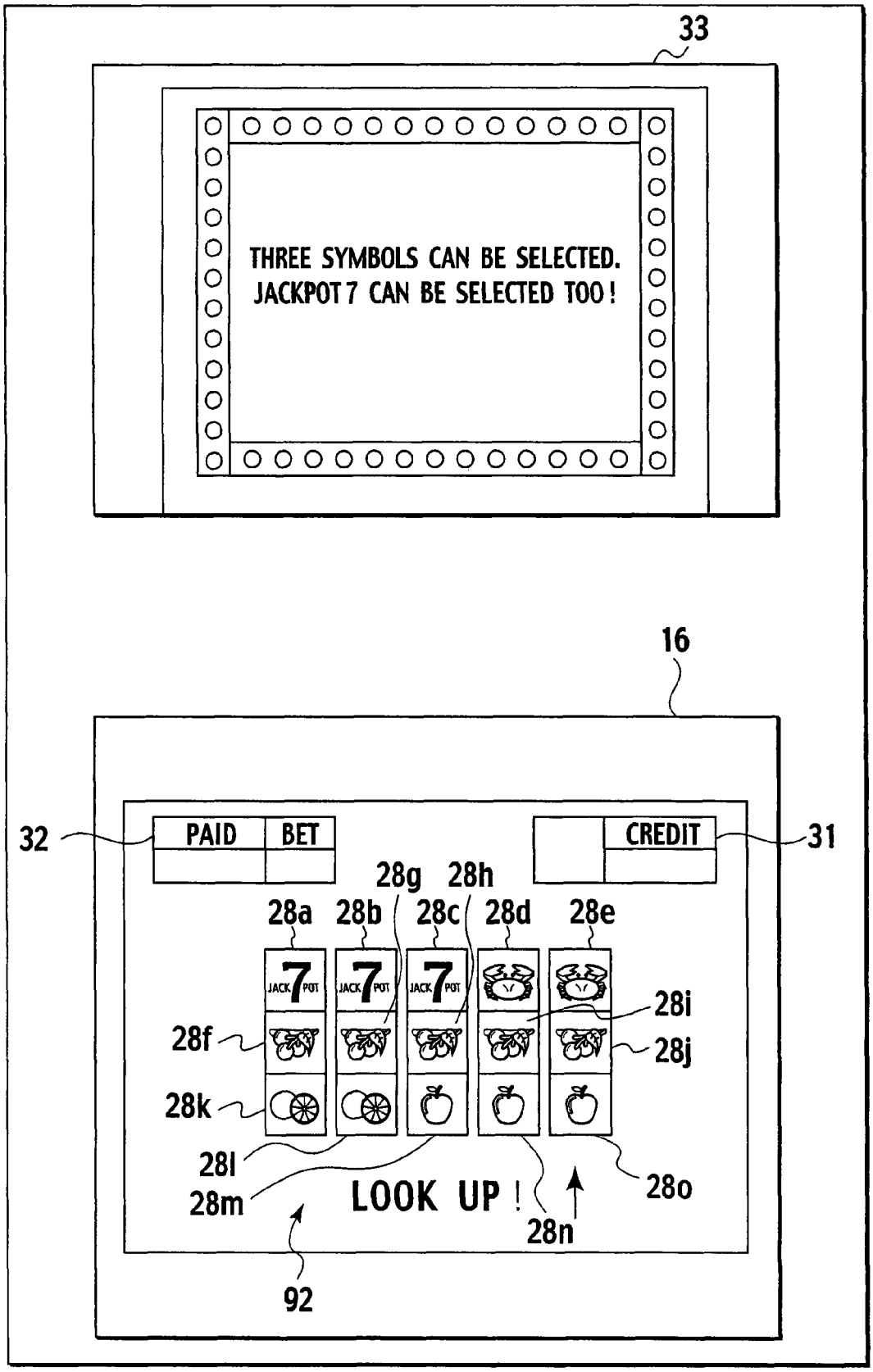
FIG. 13 is a diagram showing an exemplary display for notifying the holding of a winning combination in a slot machine according to one embodiment of the present invention.

At this point, as shown in FIG. 13, at a lower portion of the lower side image display panel 16, an image 92 of an arrow pointing upwards and letters "LOOK UP!" is displayed. In this way, it is possible to notify to the player that the symbols can be selected. It may also be made to notify this at the same time by the sound or the electric decoration.

In this example, as shown in FIG. 14A, it is assumed that the selection of symbols "JACKPOT 7" displayed in the display regions 28*a*, 28*b* and 28*c* is made.

Figure 14B:
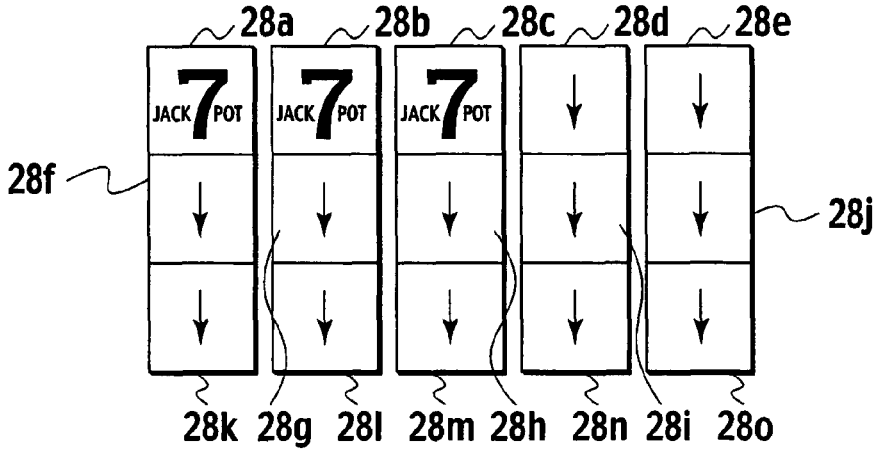
FIG. 14B is a diagram showing that the scrolling is started in a state where selected symbols are held.
Figure 14C:
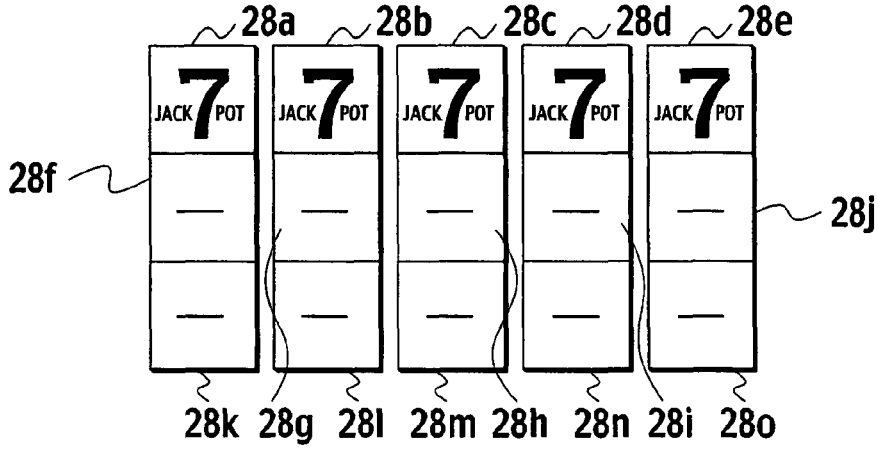
FIG. 14C is a diagram showing that symbols are rearranged and a winning combination is realized.

Then, the selected symbols (code numbers) are held in the RAM 43, and carried over to the next base game (unit game (step S40). As a result, as shown in FIG. 14B, the symbols "JACKPOT 7" are stopped in the display regions 28*a*, 28*b* and 28*c* in the next unit game while symbols are scrolled in the other display regions 28*d* to 28*o*. In this way, there is an increased expectation for having five symbols "JACKPOT 7" aligned and the payout of 50 coins obtained, as shown in FIG. 14C.

On the other hand, returning to the rearranged base game, the payout processing according to the payout set in the table will be made (step S41). In this example the payout for symbols "CHERRY (payout of 20 coins)" will be made.

Next, the symbols to be stopped determination processing shown in the step S14 of FIG. 8 will be described with reference to the flow chart shown in FIG. 10.

Figure 10:
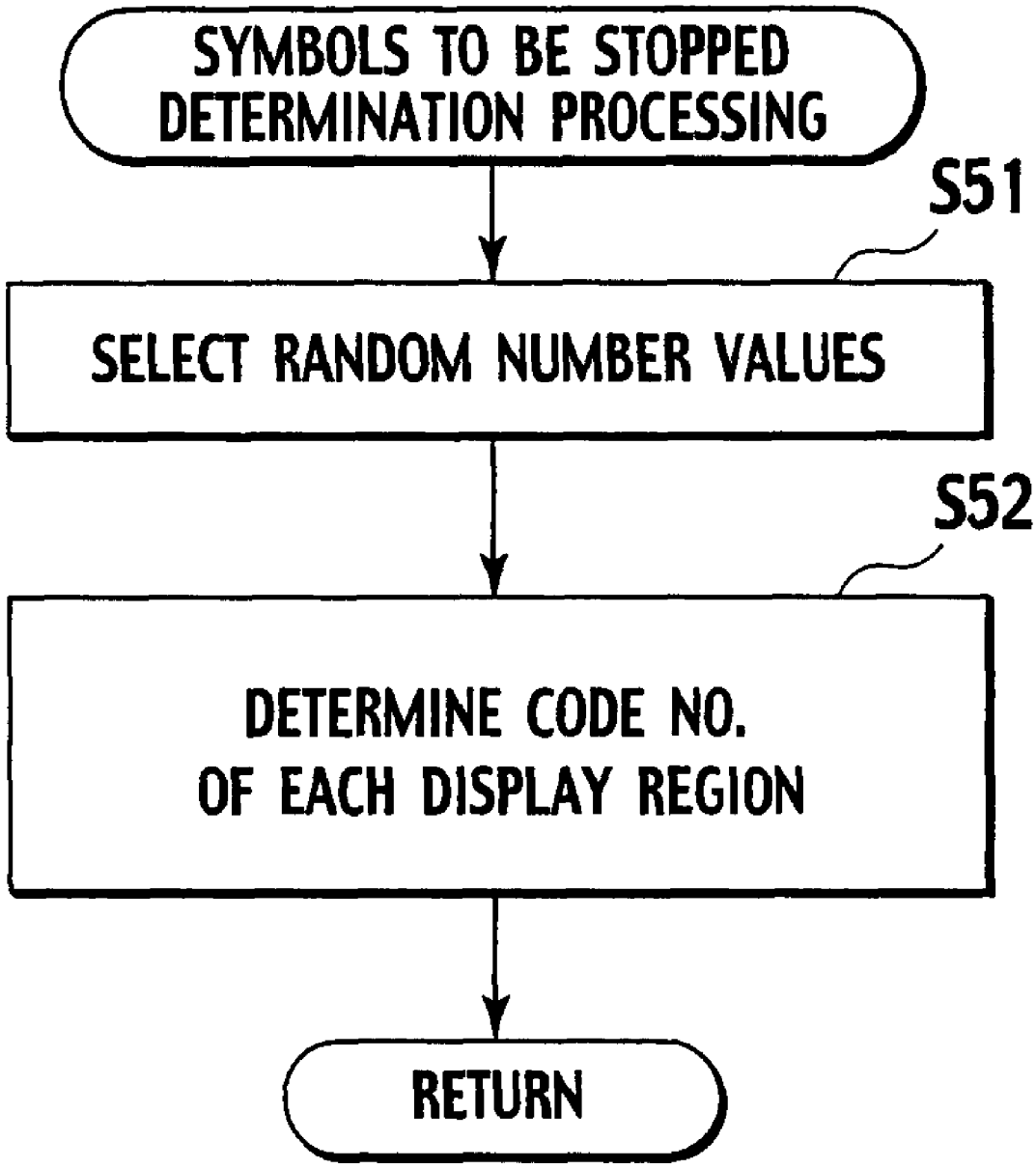
FIG. 10 is a flow chart showing a procedure of a symbols to be stopped determination processing to be executed by a slot machine according to one embodiment of the present invention.

FIG. 10 is a flow chart showing a procedure of the symbols to be stopped determination processing shown at the step S14 of FIG. 8. This processing is a processing to be carried out as the main CPU 41 executes the symbols to be stopped determination program stored in the RAM 43.

First, the main CPU 41 selects a random number value corresponding to each column of the display regions 28 (28*a* to 28*o*) from a numerical value range of 0 to 255, by executing the random number generation program contained in the symbols to be stopped determination program (step S51).

Next, the main CPU 41 refers to the symbol weighing data according to the payout rate setting data outputted from the GAL 54 and stored in the RAM 43, and determines the code numbers (see FIG. 4) for the display regions 28 (28*a* to 28*o*) according to the selected 15 random number values (step S52).

The code numbers of the display regions 28 (28*a* to 28*o*) correspond to the code numbers of symbols to be stopped and displayed on the payline. The main CPU 41 determines the winning combination by determining the code numbers of the display regions 28 (28*a* to 28*e*). For example, when the code numbers of the display regions 28 (28*a* to 28*o*) are determined as "00", "00", "00", "00" and "00", the main CPU 41 has determined the combination of symbols "APPLE" as the winning combination.

Figure 11:
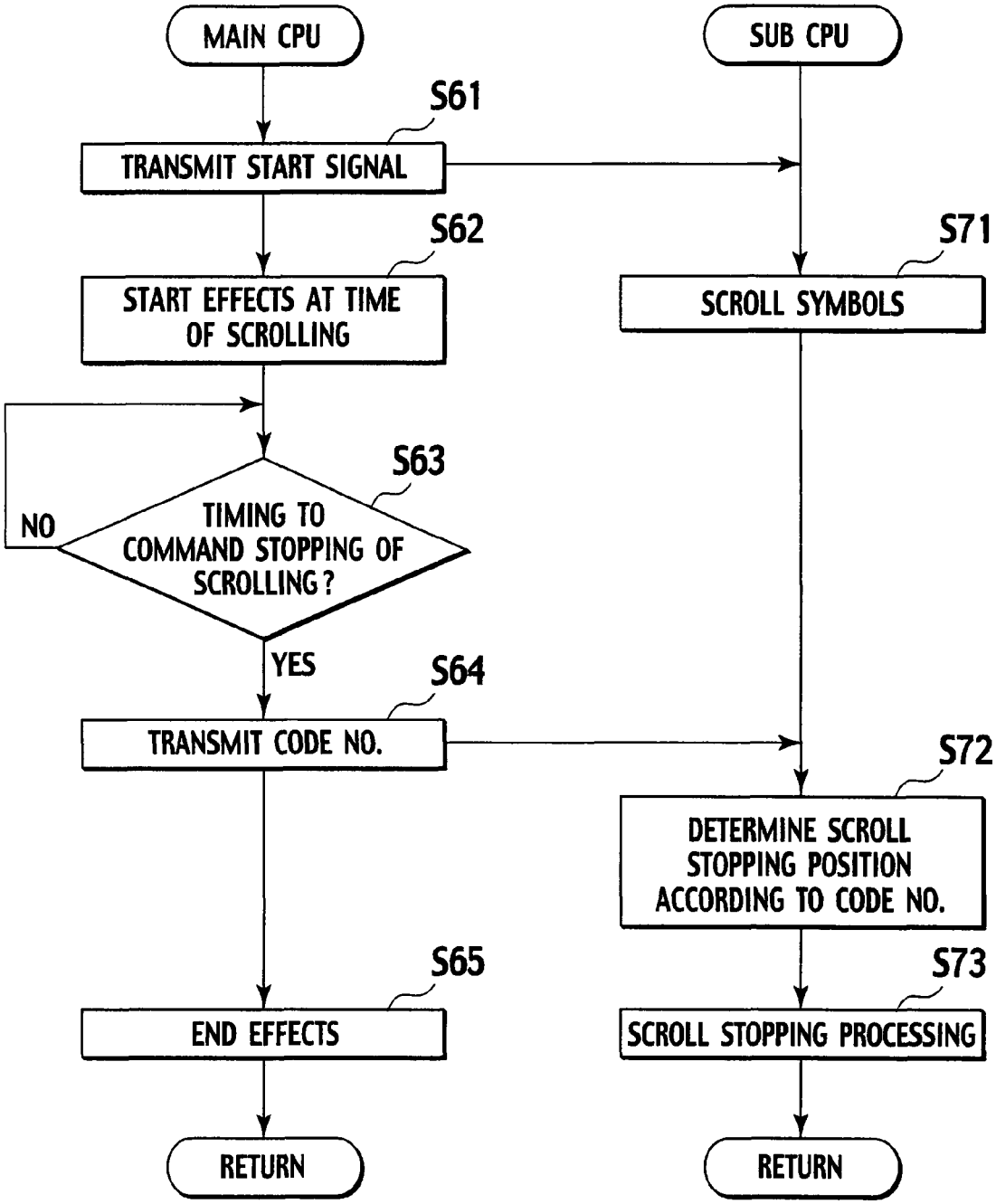
FIG. 11 is a flow chart showing a procedure of a symbols scrolling display processing to be executed by a slot machine according to one embodiment of the present invention.

FIG. 11 is a flow chart showing a procedure of the symbols scrolling display processing shown at the step S15 of FIG. 8. This processing is a processing carried out between the main CPU 41 and the sub CPU 61.

First, the main CPU 41 transmits a start signal indicating that the symbols scrolling display will be started in the display regions 28 of the liquid crystal display 17, to the sub CPU 61 (step S61). Upon receiving the start signal from the main CPU 41, the sub CPU 61 reads out the image data of symbols stored in the image data ROM 47, and carries out the scrolling of symbols in the five columns of the display regions 28 (28*a* to 28*o*) of the liquid crystal display 17 (step S71). As a result, the scrolling of symbols is started in the display regions 28 (28*a* to 28*o*).

After transmitting the start signal to the sub CPU 61 at the step S61 shown in FIG. 11, the main CPU 41 executes the effects at a time of the symbol scrolling (step S62). This processing is a processing for displaying the images on the lower side image display panel 16 and outputting sounds from the speaker 29, etc., during a period (three seconds, for example) determined according to the result of the symbols to be stopped determination processing (step S14 of FIG. 8), etc.

Next, the main CPU 41 judges whether it is a timing for commanding the stopping of the scrolling or not (step S63 of FIG. 11).

When it is judged that it is not a timing for commanding the stopping of the scrolling at the step S63, the processing is returned to the step S63 and the effects at a time of the scrolling are continued. Also, when it is judged that it is a timing for commanding the stopping of the scrolling at the step S63, the main CPU 41 transmits the code numbers of symbols stored in the RAM 43 to the sub CPU 61 (step S64). Upon receiving the code numbers of symbols from the main CPU 41, the sub CPU 61 determines the scrolling stopping position such that it corresponds to these code numbers (step S72).

After that, the scrolling stopping processing is carried out, and symbols are stopped and displayed in the display regions 28 (28*a* to 28*o*) within the display windows 15 (step S73). Also, the display processing of the effect images by the main CPU 41 is finished (step S65).

Figure 12:
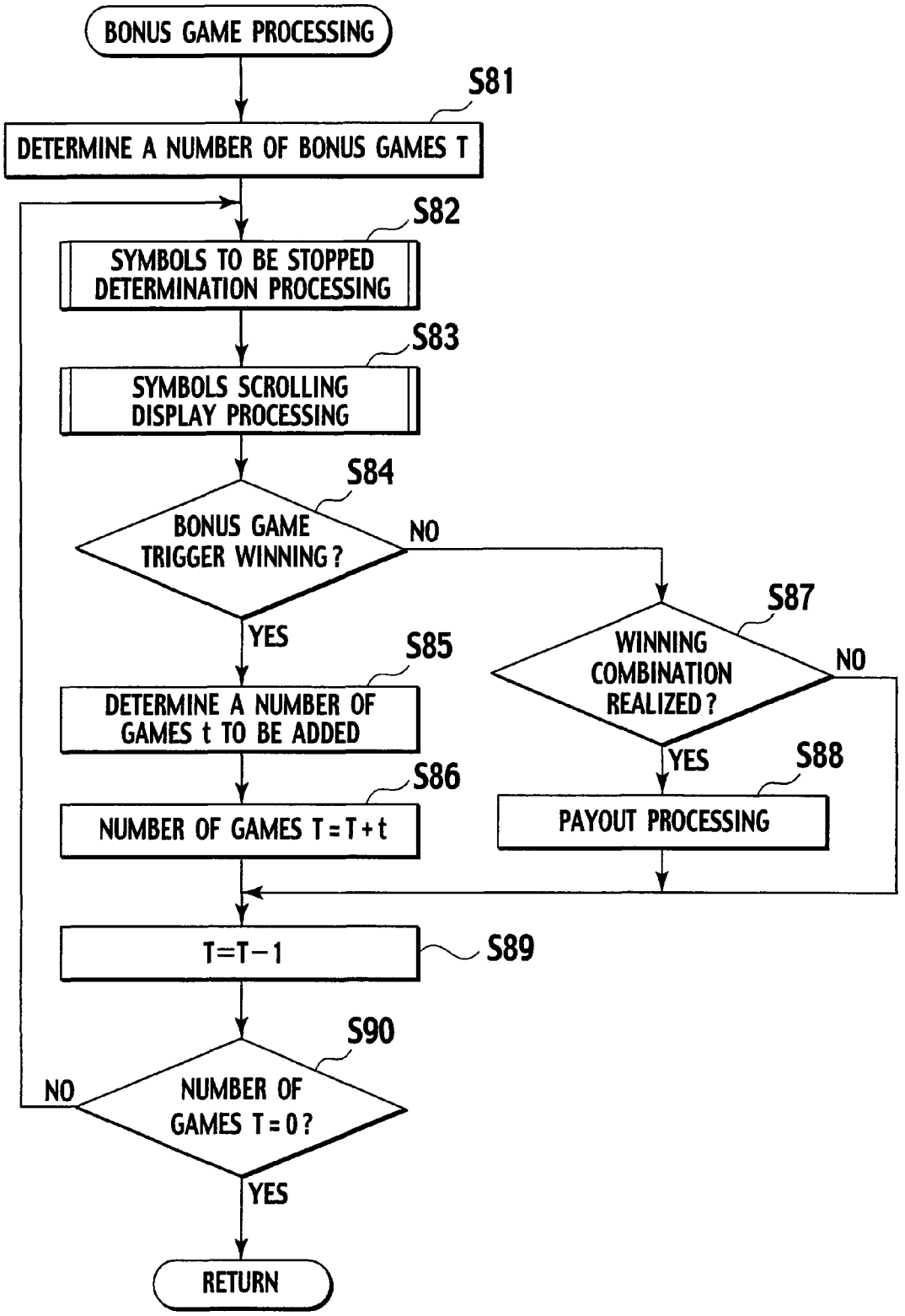
FIG. 12 is a flow chart showing a procedure of a bonus game processing to be executed by a slot machine according to one embodiment of the present invention.

FIG. 12 is a flow chart showing a procedure of the bonus game processing shown at the step S17 of FIG. 8. In the bonus game processing, first, the main CPU 41 determines the number of times for executing the bonus game T from a range of 10 to 25 games, according to the random number value obtained by executing the random number generation program contained in the symbols to be stopped determination program stored in the RAM 43 (step S81). The main CPU 41 stores the determined data on the number of games T of the bonus game into the RAM 43.

Next, the main CPU 41 carries out the symbols to be stopped determination processing (step S82) and the symbols scrolling display processing (step S83). The processing of the step S82 is similar to the processing described above with reference to FIG. 10. Also, the processing of the step S83 is similar to the processing described above with reference to FIG. 11. These processings have already been described above, so that their description will be omitted here.

Next, in FIG. 12, the main CPU 41 judges whether the bonus game trigger is realized or not, that is, whether the combination of symbols "APPLE" is stopped on the payline formed in the display regions 28 (28*a* to 28*o*) inside the display windows 15 or not (step S84). When it is judged that the bonus game trigger is realized (step S84 YES), the number t of repetitions of the bonus game is newly determined (step S85), and the determined number t of repetitions is added to the current number of games T of the bonus game (step S86). In this way, when the bonus game is won again during the bonus game, the remaining number of the bonus games will be increased.

When the bonus game is not realized, the main CPU 41 judges whether the winning combination is realized or not (step S87). When it is judged that the winning combination is realized, the main CPU 41 makes the payout of coins according to the number of coins entered and the winning combination (step S88). At this point, the payout according to the payout table shown in FIG. 5 is made.

When the processing of the steps S86 or S88 is executed, or when it is judged that any of the winning combinations is not realized at the step S87 (it is judged as a lost game), the main CPU 41 reads out the number of games T of the bonus game stored in the RAM 43, subtracts one from the read out value of the number of games T, and stores the number of games T after the subtraction into the RAM 43 again (step S89).

Next, the main CPU 41 judges whether the number of games T of the bonus game has reached the number of times determined at the step S81 or not (step S90). More specifically, it is judged by judging whether the number of games T stored in the RAM 43 has become zero or not, and when the number of games T is not zero, that is, when it is judged that the number of executed bonus games has not reached the number of times determined at the step S81, the processing is returned to the step S82 and the above described processing is repeated.

On the other hand, when the number of games T is zero, that is, when it is judged that the number of executed bonus games has reached the number of games T determined at the step S81, the processing is finished. The bonus game is carried out in this way.

FIG. 13 shows an exemplary display to be displayed on the upper side image display panel 33 and the lower side image display panel 16 when the winning combination holding processing is executed. On the lower portion of the lower side image display panel 16, an image 92 of an arrow pointing upwards and letters "LOOK UP!" is displayed. The image 92 is for urging the player to look at the upper side image display panel 33.

On the upper side image display panel 33, letters "Three symbols can be selected" and "JACKPOT 7 can be selected too!" are displayed. By looking at this display, the player can recognize that the selected three symbols can be carried over to the next unit game. Also, the player can recognize that it is possible to select "JACKPOT 7" which is the special symbol.

In this way, the number of symbols that can be held in the current base game among symbols rearranged in the display regions 28 (28*a* to 28*o*) in the previous base game (unit game) is determined. Then, among symbols to be rearranged in the display regions 28, only as many symbols that have been set to be capable of being held as the number that is determined to be capable of being held will be set as capable of being held, and only in a case where a payout amount by the previous base game reached a prescribed payout amount, the symbols "JACKPOT 7" that have not been set to be capable of being held will be set to be capable of being held in the current base game.

Consequently, a probability for having the winning combination aligned by symbols with higher payout amount such as "JACKPOT 7" becomes higher so that it becomes possible to increase the player's interest into the game, and the benefit can be carried over for a plurality of base games so that it becomes possible to maintain the interests by giving additional values to a plurality of unit games. On the other hand, when symbols are rearranged, even if the payout is not realized, it is possible to maintain an expectation of the player to the next base game so that it is possible to prevent the player from losing interests into the game.

Also, as a control for randomly determining the number of symbols that can be selected among a plurality of rearranged symbols is carried out, the expectation to the base game (unit game) changes each time so that it is possible to increase the player's interest into the game further.

Also, as a control for determining the number of base games (unit games) for which the selected symbols can be held is carried out, it becomes possible to increase the concentration of the player with respect to the games because the expectation to the games become high during a prescribed number of the base games especially, and it becomes possible to limit the frequent realization of the winning combination by symbols associated with a higher payout such as "JACKPOT 7".

In the above, the embodiments of the slot machine according to the present invention have been described, but they are only showing some of the specific examples, they are not intended to limit the present invention particularly, and the specific configuration of each means or the like can be appropriately changed by design. Also, the effects described in the embodiments of the present invention are only listing the most preferable effects arising from the present invention, and the effects of the present invention are not limited to those described in the embodiments of the present invention.

What is claimed is:

1. A slot machine, comprising:

a display having a plurality of display regions, for arranging and rearranging symbols in the display regions in each unit game; and a controller:

(a) determining whether a number of symbols from a previous unit game can be held over into a rearrangement of symbols in a current unit game, (b) holding over, in the current unit game, a number of symbols identified as being capable of being held over from the previous unit game, and (c) when a payout amount of a winning combination realized by the symbols rearranged in the previous unit game reaches a prescribed payout amount, allowing a number of symbols not previously identified as being capable of being held over based on said initial determination, to be held over in the current unit game.

2. The slot machine of claim 1, wherein the controller randomly sets an upper limit for the number of symbols that can be held in the current unit game from among symbols arranged in the previous unit game.

3. The slot machine of claim 1, wherein the controller sets a number of times by which symbols are to be set as capable of being held consecutively, for those symbols which are rearranged at identical display regions in each unit game.

4. A slot machine, comprising:

a display having a plurality of display regions, for arranging and rearranging symbols in the display regions in each unit game; and a controller:

(a) randomly determining an upper limit for a number of symbols that can be held in a current unit game from among symbols rearranged in the display regions by a previous unit game, (b) holding over, in the current unit game, a number of symbols identified as capable of being held over from the previous game based on the random determination, and (c) where a payout amount in the previous unit game reaches a prescribed payout amount, holding over a number of symbols not previously identified as being capable of being held over, based on said random determination, in a subsequent unit game.

5. The slot machine of claim 4, wherein the controller sets a number of times by which symbols are to be set as capable of being held consecutively, for those symbols which are rearranged at identical display regions in each unit game.

6. A slot machine, comprising:

a display having a plurality of display regions, for arranging and rearranging symbols in the display regions in each unit game; and a controller:

(a) randomly determining an upper limit for a number of symbols that can be held in a current unit game from among symbols rearranged in the display regions by a previous unit game, (b) holding over, in the current unit game, a number of symbols identified as being capable of being held over from the previous game, (c) where a payout amount in the previous unit game reaches a prescribed payout amount, holding over a number of symbols not previously identified as being capable of being held over, based on said random determination, in a subsequent unit game, and (d) setting a number of times which symbols are capable of being held consecutively, for those symbols which are rearranged at identical display regions in each unit game.

7. A playing method of a slot machine, comprising the steps of:

(a) using a controller to set as many symbols that have been set to be capable of being held as a determined number from among a plurality of symbols arranged in a plurality of display regions provided in a display by a previous unit game as capable of being held in a current unit game, when the current unit game is started;

(b) using a controller to set symbols that have not been set to be capable of being held also as capable of being held in the current unit game only in a case where a payout amount of a winning combination realized by the symbols rearranged in the previous unit game reaches a prescribed payout amount.

8. The playing method of a slot machine of claim 7, further comprising the step of randomly setting an upper limit for a number of symbols that can be held in the current unit game among symbols arranged in the display regions by the previous unit game.

9. The playing method of a slot machine of claim 7, further comprising the step of setting a number of times by which symbols are to be set as capable of being held consecutively, for those symbols which are rearranged at identical display regions in each unit game.

10. A playing method of a slot machine, comprising the steps of:

(a) using a controller to set a number of symbols that have been set to be capable of being held as a randomly determined number among a plurality of symbols arranged in a plurality of display regions provided in a display by a previous unit game as capable of being held in a current unit game, when the current unit game is started; and (b) using the controller to set symbols that have not been set to be capable of being held also as capable of being held in the current unit game only in a case where a payout amount in the previous unit game reached a prescribed payout amount.

11. The playing method of a slot machine of claim 10, further comprising the step of setting a number of times by which symbols are to be set as capable of being held consecutively, for those symbols which are rearranged at identical display regions in each unit game.

12. A playing method of a slot machine, comprising the steps of:

(a) using a controller to set as many symbols on a slot machine that have been set to be capable of being held as a randomly determined number among a plurality of symbols arranged in a plurality of display regions provided in a display by a previous unit game as capable of being held in a current unit game, when the current unit game is started;

(b) using the controller to set symbols that have not been set to be capable of being held also as capable of being held in the current unit game only in a case where a payout amount in the previous unit game reached a prescribed payout amount; and (c) using the controller to set a number of times by which symbols are to be set as capable of being held consecutively, for those symbols which are rearranged at identical display regions in each unit game.

* * * * *